US010649352B2

(12) United States Patent
Tsuji et al.

(10) Patent No.: US 10,649,352 B2
(45) Date of Patent: May 12, 2020

(54) ELECTROPHOTOGRAPHIC MEMBER, METHOD FOR PRODUCING ELECTROPHOTOGRAPHIC MEMBER, AND ELECTROPHOTOGRAPHIC IMAGE FORMING APPARATUS

(71) Applicant: CANON KABUSHIKI KAISHA, Tokyo (JP)

(72) Inventors: Yasutomo Tsuji, Tokyo (JP); Yohei Miyauchi, Tokyo (JP); Toshio Tanaka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 233 days.

(21) Appl. No.: 15/967,832

(22) Filed: May 1, 2018

(65) Prior Publication Data

US 2018/0329319 A1 Nov. 15, 2018

(30) Foreign Application Priority Data

May 12, 2017 (JP) ..... 2017-095720
Apr. 3, 2018 (JP) ..... 2018-071724

(51) Int. Cl.

*G03G 5/05* (2006.01)
*G03G 15/01* (2006.01)
*G03G 15/16* (2006.01)

(52) U.S. Cl.

CPC ..... *G03G 5/0514* (2013.01); *G03G 5/0521* (2013.01); *G03G 5/0578* (2013.01); *G03G 15/0131* (2013.01); *G03G 15/0189* (2013.01); *G03G 15/162* (2013.01)

(58) Field of Classification Search

CPC ..... G03G 15/0131; G03G 15/0189; G03G 15/162; G03G 5/0514; G03G 5/0521; G03G 5/0578

See application file for complete search history.

(56) References Cited

U.S. PATENT DOCUMENTS

| | | | | |
|---|---|---|---|---|
| 5,284,729 | A | 2/1994 | Tanaka et al. | |
| 9,367,008 | B2 | 6/2016 | Sakakibara et al. | |
| 9,575,439 | B2 | 2/2017 | Tsuji | |
| 9,606,478 | B2 | 3/2017 | Tsuji | |
| 2014/0356040 | A1 | 12/2014 | Sakakibara et al. | |
| 2015/0353832 | A1* | 12/2015 | Xu | C09K 21/12 252/607 |

FOREIGN PATENT DOCUMENTS

| | | | |
|---|---|---|---|
| JP | 2-181043 | A | 11/1990 |
| JP | H04-266912 | * | 12/1992 |
| JP | 2013-200324 | A | 10/2013 |

OTHER PUBLICATIONS

Machine translation of JP H04-266912, retrieved Mar. 22, 2020.*
Machine translation of JP JP 2013/200324 retrieved Mar. 22, 2020.*

* cited by examiner

*Primary Examiner* — Michael B Nelson
(74) *Attorney, Agent, or Firm* — Venable LLP

(57) ABSTRACT

To provide an electrophotographic member high in volume resistivity uniformity even in application of a high voltage such as 1,000 V. The electrophotographic member includes a base material and an elastic layer on the base material, the elastic layer containing a silicone rubber and an ionic liquid, and the ionic liquid including a cation modified by a dimethylsiloxane chain, and an anion.

19 Claims, 1 Drawing Sheet

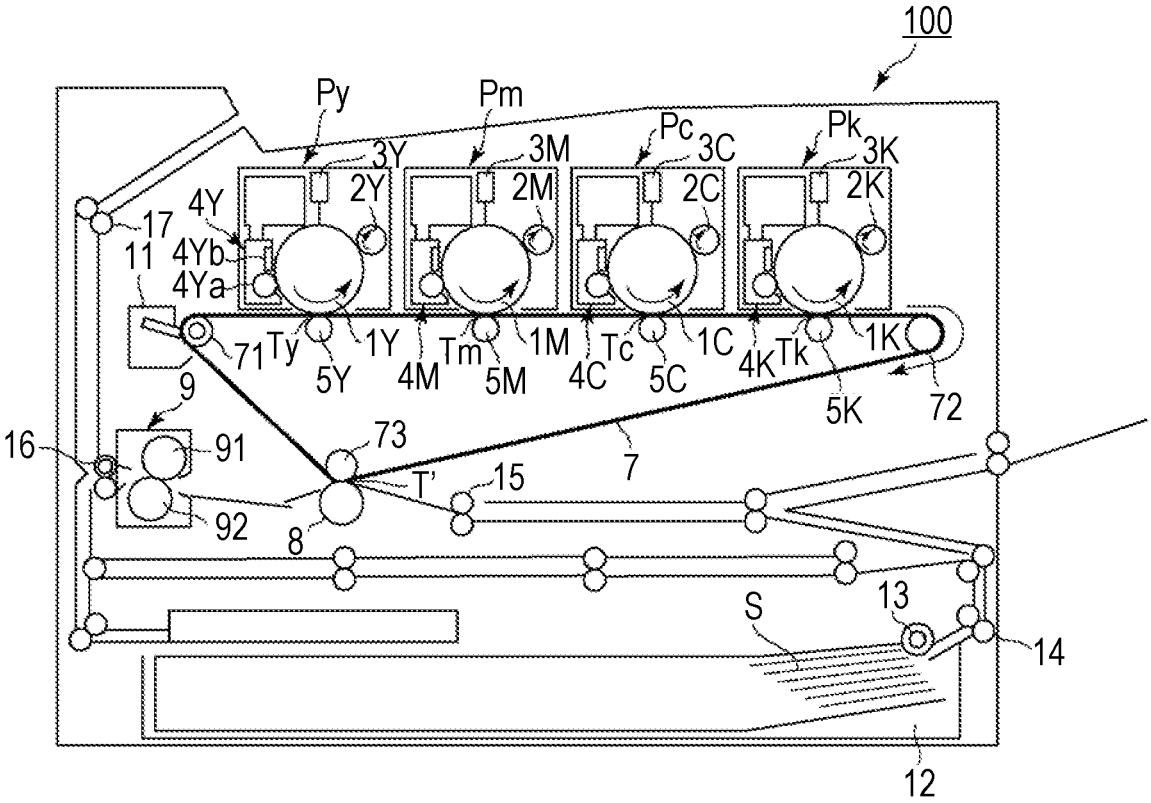
100
Py
Pm
Pc
Pk
3Y
3M
3C
3K
2Y
2M
2C
2K
4Y
4Yb
4Ya
17
11
71
Ty
5Y
1Y
4M
Tm
5M
1M
4C
Tc
5C
1C
4K
Tk
5K
1K
72
9
91
92
16
73
T'
15
7
8
S
13
14
12

ELECTROPHOTOGRAPHIC MEMBER, METHOD FOR PRODUCING ELECTROPHOTOGRAPHIC MEMBER, AND ELECTROPHOTOGRAPHIC IMAGE FORMING APPARATUS

BACKGROUND OF THE INVENTION

Field of the Invention

The present disclosure relates to an electrophotographic member for use in an electrophotographic image forming apparatus, a method for producing the electrophotographic member, and an electrophotographic image forming apparatus.

Description of the Related Art

In recent years, electrophotographic image forming apparatuses have been demanded to be able to form a high-quality electrophotographic image even on a recording medium having a non-smooth surface, like a cardboard or embossed paper having a paper basis weight of more than 300 g/m$^2$. The recording medium having a non-smooth surface, however, when an electrophotographic image is formed on the surface of the recording medium, may be insufficient in transfer of a toner image to a depressed portion of the surface of the recording medium.

In order to address such a problem, it is effective to use an intermediate transfer belt having an elastic layer, excellent in followability to the surface shape of a recording medium.

As an electroconductive member for electrophotographic equipment for use in such an intermediate transfer belt, Japanese Patent Application Laid-Open No. 2013-200324 discloses an electroconductive member for electrophotographic equipment, the electroconductive member including a rubber elastic member formed from a crosslinked product of a silicone rubber composition including liquid or millable silicone rubber, a crosslinking agent, an electroconductive agent and an ionic liquid having an alkoxysilyl group in a molecular structure. Japanese Patent Application Laid-Open No. 2013-200324 then describes the following: such an electroconductive member, in which the electroconductive agent and the ionic liquid are used in combination, is thus lessened in the resistance variation due to dispersivity of the electroconductive agent, resulting in an enhancement in electrical responsiveness, and the ionic liquid has an alkoxysilyl group and is excellent in compatibility with the silicone rubber, thereby resulting in small resistance variation as compared with other ionic liquids (paragraph [0012]).

According to studies by the present inventors, it has been found to be effective for transferring a toner on an intermediate transfer belt to the depressed portion of the above recording medium having a non-smooth surface to allow a secondary transfer voltage to be a high voltage such as 1,000 V. The present inventors have then made studies about the electroconductive member according to Japanese Patent Application Laid-Open No. 2013-200324, and have found that, when the voltage applied in resistance measurement is a low voltage such as 10 V, the volume resistivity is relatively uniform, and, however, when the voltage applied is a high voltage such as 1,000 V, the volume resistivity is ununiform in some cases.

One aspect of the present disclosure is directed to providing an electrophotographic member high in volume resistivity uniformity even in application of a high voltage such as 1,000 V. In addition, another aspect of the present disclosure is directed to providing an electrophotographic image forming apparatus that can stably form a high-quality electrophotographic image over a long period.

SUMMARY OF THE INVENTION

According to one aspect of the present disclosure, there is provided an electrophotographic member including a base material and an elastic layer on the base material, wherein the elastic layer contains a cured product of addition curable type liquid silicone rubber and an ionic liquid, and the ionic liquid includes a cation modified by a dimethylsiloxane chain, and an anion.

In addition, according to another aspect of the present disclosure, there is provided a method for producing an electrophotographic member, the method including forming a layer of a mixture of addition curable type liquid silicone rubber and an ionic liquid on a base material, and curing the addition curable type liquid silicone rubber in the layer of the mixture.

Furthermore, according to another aspect of the present disclosure, there is provided an electrophotographic image forming apparatus including the electrophotographic member.

Further features of the present disclosure will become apparent from the following description of exemplary embodiments with reference to the attached drawing.

BRIEF DESCRIPTION OF THE DRAWINGS

FIGURE is a cross-sectional view illustrating one example of an electrophotographic image forming apparatus using an electrophotographic member according to one embodiment of the present disclosure.

DESCRIPTION OF THE EMBODIMENTS

Preferred embodiments of the present disclosure will now be described in detail in accordance with the accompanying drawing.

An electrophotographic member according to one embodiment of the present disclosure includes a base material and an elastic layer on the base material. The elastic layer contains a cured product of addition curable type liquid silicone rubber and an ionic liquid, and the ionic liquid includes a cation modified by a dimethylsiloxane chain, and an anion. The present inventors have made studies, and as a result, have revealed that an elastic layer including an ionic liquid having a cation modified by a dimethylsiloxane chain allows the resistance variation of the elastic layer to be lessened and allows an electrophotographic member excellent in volume resistivity uniformity to be obtained even in application of a high voltage of 1,000 V.

The reason why the electrophotographic member according to the present embodiment exerts the above effect is considered as follows. One factor affecting volume resistivity uniformity is the dispersion state of the ionic liquid in the silicone rubber constituting the elastic layer. Non-polar silicone rubber is inferior in compatibility with an ionic liquid having polarity. For example, even if an ionic liquid including a quaternary ammonium salt cation and bis(trifluoromethanesulfonyl)imide (hereinafter, referred to as "TFSI") is added to the silicone rubber and mixed therewith, the ionic liquid and the silicone rubber are not compatible with each other and the ionic liquid is separated on the surface. In addition, while the ionic liquid having an alkoxysilyl group according to Japanese Patent Application Laid-Open No. 2013-200324 is certainly enhanced in compatibility with silicone rubber, the dispersion state of the ionic liquid in the silicone rubber is considered to be lowered in application of a voltage of 1,000 V.

On the other hand, the ionic liquid in the electrophotographic member according to the present embodiment includes a cation modified by a dimethylsiloxane chain having a similar chemical structure to the structure of silicone rubber as a matrix. Therefore, it is considered that the ionic liquid is extremely high in compatibility with the silicone rubber and the dispersion state thereof in the silicone rubber is hardly ununiform even in application of a high voltage.

[Elastic Layer]

(Silicone Rubber)

First, the silicone rubber included in the elastic layer is described.

The silicone rubber is a cured product of addition curable type liquid silicone rubber. In general, the addition curable type liquid silicone rubber includes the following components (a), (b) and (c):

(a) an organopolysiloxane having an unsaturated aliphatic group;

(b) an organopolysiloxane having active hydrogen bound to a silicon atom; and (c) a platinum compound as a crosslinking catalyst.

Examples of the organopolysiloxane having an unsaturated aliphatic group, as the component (a), include the following:

- a linear organopolysiloxane in which both ends of the molecular are each represented by $(R_1)_2R_2SiO_{1/2}$ and an intermediate unit is represented by $(R_1)_2SiO$ and $R_1R_2SiO$; and—a branched organopolysiloxane in which an intermediate unit includes $R_1SiO_{3/2}$ or $SiO_{4/2}$.

$R_1$ here represents an unsubstituted or substituted monovalent hydrocarbon group having no unsaturated aliphatic group, bound to a silicon atom in the above formula. Specific examples of the hydrocarbon group include the following:

- alkyl groups (such as a methyl group, an ethyl group, a propyl group, a butyl group, a pentyl group and a hexyl group); and
- aryl groups (a phenyl group, a naphthyl group and the like).

Examples of the substituent optionally in the hydrocarbon group include halogen atoms such as a fluorine atom and a chlorine atom; alkoxy groups such as a methoxy group and an ethoxy group; and a cyano group. Specific examples of the substituted hydrocarbon group include a chloromethyl group, a 3-chloropropyl group, a 3,3,3-trifluoropropyl group, a 3-cyanopropyl group and a 3-methoxypropyl group. In particular, 50% or more of $R_1$ preferably represents a methyl group and all of $R_1$ more preferably represents a methyl group from the viewpoint that synthesis and handling are easy and excellent heat resistance is achieved.

In addition, $R_2$ represents an unsaturated aliphatic group bound to a silicon atom in the above formula. Examples of the unsaturated aliphatic group include a vinyl group, an allyl group, a 3-butenyl group, a 4-pentenyl group and a 5-hexenyl group. In particular, a vinyl group can be adopted from the viewpoint that synthesis and handling are easy and a crosslinking reaction of the silicone rubber easily progresses.

The organopolysiloxane having active hydrogen bound to a silicon atom, as the component (b), is a crosslinking agent that reacts with the unsaturated aliphatic group in the component (a) by the catalytic action of the platinum compound as the component (c), to form a crosslinked structure. The number of active hydrogen bound to a silicon atom in the component (b) can be more than 3 on average in one molecule.

With respect to the organopolysiloxane having active hydrogen bound to a silicon atom, as the component (b), examples of the organic group bound to a silicon atom include an unsubstituted or substituted monovalent hydrocarbon group having no unsaturated aliphatic group, as in $R_1$ of the component (a). In particular, the organic group can be a methyl group from the viewpoint that synthesis and handling are easy. The molecular weight of the organopolysiloxane having active hydrogen bound to a silicon atom is not particularly limited.

In addition, the viscosity at 25° C. of the component (b) is preferably 10 $mm^2/s$ or more and 100,000 $mm^2/s$ or less, more preferably 15 $mm^2/s$ or more and 1,000 $mm^2/s$ or less. When the viscosity at 25° C. of the organopolysiloxane is within the above range, the following is not caused: volatilization during storage causes a desired degree of crosslinking and desired physical properties of a molded product not to be achieved; and also synthesis and handling are facilitated to allow uniform dispersion in a system to easily occur.

The siloxane backbone of the component (b) may be any of linear, branched and cyclic backbones, and a mixture thereof may be used. In particular, a linear backbone can be adopted from the viewpoint of easiness of synthesis. In addition, a Si—H bond in the component (b) may be present in any siloxane unit in the molecule, and at least a part thereof can be present in a siloxane unit at an end of the molecule, such as an $(R_1)_2HSiO_{1/2}$ unit.

The addition curable type liquid silicone rubber is preferably one in which the amount of the unsaturated aliphatic group based on 1 mol of a silicon atom is 0.1% by mol or more and 2.0% by mol or less, more preferably 0.2% by mol or more and 1.0% by mol or less.

The hardness of the silicone rubber after curing is, in terms of the type A hardness, preferably 20 degrees or more and 80 degrees or less, more preferably 45 degrees or more and 80 degrees or less.

The thickness of the silicone rubber after curing is preferably 50 μm or more and 500 μm or less, more preferably 100 μm or more and 400 μm or less in consideration of mechanical strength and flexibility.

A known platinum compound can be used as the component (c).

(Ionic Liquid)

The ionic liquid is described. The ionic liquid is not particularly limited as long as the ionic liquid includes a cation modified by a dimethylsiloxane chain, and an anion. Examples of the cation structure include a structure in which quaternary ammonium and a dimethylsiloxane chain are bound, as represented by structural formula (1). The cation may also be phosphonium represented by structural formula (2), sulfonium, and one having a cyclic structure.

Examples of such one having a cyclic structure include imidazolium, pyrrolidinium, piperidinium, pyridinium and morpholinium. Examples of a cation having an imidazolium backbone as a cyclic structure are represented by structural formula (3) and formula (4).

Structural formula (1)

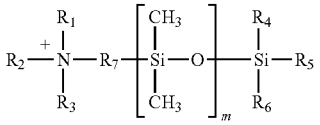

Structural formula (2)

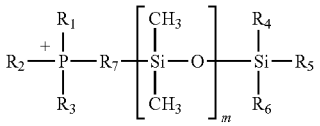

In structural formula (1) and structural formula (2), each of $R_1$ to $R_3$ independently represents a functional group such as a linear or branched alkyl group having 1 to 10 carbon atoms, an alkoxy group having 1 to 10 carbon atoms, a hydroxyl group, a benzyl group or a carboxyl group. Such a functional group may be bound to a nitrogen atom of quaternary ammonium directly or via an alkyl group or the like. $R_1$ to $R_3$ can be each a linear or branched alkyl group having 1 to 10 carbon atoms.

Each of $R_4$ to $R_6$ independently represents a linear or branched alkyl group having 1 to 10 carbon atoms.

$R_7$ represents a linking group of a quaternary ammonium structure and a dimethylsiloxane chain. Examples of $R_7$ include a form obtained by a coupling reaction of a quaternary ammonium salt and polydimethylsiloxane, described in Examples below. More specifically, examples of $R_7$ include an alkylene group (which may be any of linear and branched groups) having 1 to 20 carbon atoms and optionally having a substituent. The alkylene group is optionally configured via a group selected from the group consisting of -Ph-(phenylene), —O—, —C(═O)—, —C(═O)—O— or —C(═O)—NR— (wherein R represents an alkyl group having 1 to 6 carbon atoms). Examples of the substituent of the alkylene group include a hydroxyl group.

The length m of the dimethylsiloxane chain is an integer of 1 or more and 150 or less.

Structural formula (3)

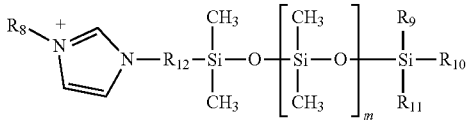

Structural formula (4)

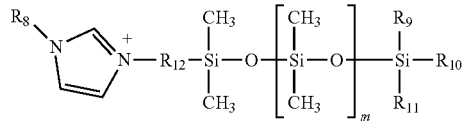

In structural formula (3) and structural formula (4), each $R_8$ independently represents an alkyl group having 1 to 10 carbon atoms (which may be any of linear and branched groups), an alkoxy group having 1 to 10 carbon atoms, a benzyl group or a carboxyl group. $R_8$ can be an alkyl group having 1 to 10 carbon atoms. Each of $R_9$ to $R_{11}$ independently represents an alkyl group having 1 to 10 carbon atoms (which may be any of linear and branched groups).

$R_{12}$ represents a linking group of an imidazolium structure and a dimethylsiloxane chain. Examples of $R_{12}$ include a form obtained by a coupling reaction of an imidazolium salt and polydimethylsiloxane, described in Examples below. More specifically, examples of $R_{12}$ include an alkylene group (which may be any of linear and branched groups) having 1 to 20 carbon atoms and optionally having a substituent. The alkylene group is optionally configured via a group selected from the group consisting of -Ph-(phenylene), —O—, —C(═O)—, —C(═O)—O— or —C(═O)—NR— (wherein R represents an alkyl group having 1 to 6 carbon atoms). Examples of the substituent of the alkylene group include a hydroxyl group.

The length m of the dimethylsiloxane chain is an integer of 1 or more and 150 or less.

In structural formulae (1) to (4), the length (m in the structural formula) of the dimethylsiloxane chain is an integer of 1 or more and 150 or less and can be an integer of 5 or more and 65 or less from the viewpoint of compatibility with the silicone rubber. When m represents 5 or more, the ionic liquid can be sufficiently compatible with the silicone rubber, thereby uniformizing the resistance. When m represents 65 or less, the ionic liquid can be kept at a low viscosity. A low-viscosity ionic liquid can control deterioration in conductivity due to a reduction in the degree of ion movement in the silicone rubber.

The anion included in the ionic liquid is not particularly limited. The anion is preferably at least one selected from the group consisting of $AlCl_4^-$, $Al_2Cl_7^-$, $NO_3^-$, $BF_4^-$, $PF_6^-$, $CH_3COO^-$, $CF_3COO^-$, $CF_3SO_3^-$, $(CF_3SO_2)_3C^-$, $AsF_6^-$, $SbF_6^-$, $F(HF)n^-$, $CF_3CF_2CF_2CF_2SO_3^-$, $(CF_3CF_2SO_2)_2N^-$, $CF_3CF_2CF_2COO^-$ and $(CF_3SO_2)_2N^-$(TFSI$^-$). When the anion is used in the electrophotographic member, TFSI$^-$ is more preferable because of being less affected by the humidity.

The amount of the ionic liquid included in the elastic layer is preferably 0.01 to 10 parts by mass, more preferably 0.05 to 5 parts by mass based on 100 parts by mass of the silicone rubber. When the amount of the ionic liquid is 0.01 parts by mass or more, adjustment to a desired resistance is facilitated. In addition, when the amount of the ionic liquid is 10 parts by mass or less, the environmental variation in resistivity at a high humidity is easily controlled. Such an ionic liquid may be used singly or in combinations of two or more thereof.

(Additive)

The elastic layer may include an electroconductive agent as long as the effect according to the present embodiment is not impaired. Examples of the electroconductive agent include conductive carbon black such as acetylene black and ketjen black, graphite, graphene, a carbon fiber, a carbon nanotube, powders of metals such as silver, copper and nickel, a conductive zinc flower, conductive calcium carbonate, conductive titanium oxide, conductive tin oxide and conductive mica. In particular, conductive carbon black can be used from the viewpoint of easiness of resistance control.

The amount of the electroconductive agent compounded to the elastic layer is preferably 35 parts by mass or less, more preferably 25 parts by mass or less based on 100 parts by mass of the silicone rubber from the viewpoint of mechanical strength. The electroconductive agent is added to thereby impart, to the elastic layer, stable conductivity suitable for an intermediate transfer belt, a transfer fixing belt and the like.

The elastic layer may additionally include additives such as a filler, a crosslinking promoter, a crosslinking retarder, a crosslinking aid, an antiscorching agent, an antiaging agent, a softening agent, a heat stabilizer, a flame retardant, a flame retardant aid, an ultraviolet absorber and an anticorrosive agent.

In particular, examples of the filler include reinforcing fillers such as fumed silica, crystalline silica, wet silica, fumed titanium oxide and a cellulose nanofiber. Such a reinforcing filler is easily dispersed in the silicone rubber, and therefore may be surface-modified by an organosilicon compound such as organoalkoxysilane, organohalosilane, organosilazane, a diorganosiloxane oligomer where both ends of the molecule are each capped by a silanol group, or cyclic organosiloxane.

Furthermore, when hydrophilic silica is used as the filler, conductivity of the elastic layer can be much more enhanced and voltage dependency of conductivity of the elastic layer can be much more lowered. The voltage dependency refers to the change in resistivity depending on the voltage applied in resistance measurement. For example, when the value measured at a voltage applied of 100 V and the resistivity measured at 1000 V are compared, the case of measurement at 1000 V tends to allow the volume resistivity to be measured at a lower value. For example, when the elastic layer contains an electroconductive agent such as carbon black together with the ionic liquid according to the present embodiment, the voltage dependency of the elastic layer tends to be increased. On the other hand, when the elastic layer contains hydrophilic silica together with the ionic liquid according to the present embodiment, the volume resistivity of the elastic layer can be decreased and the voltage dependency of the volume resistivity can be lowered. The hydrophilic silica here specifically refers to a silica having a pH value of 7.0 or less, particularly, 3.5 or more and 5.0 or less. Examples of such hydrophilic silica can include "AEROSIL 90" (pH value: 3.7 to 4.7), "AEROSIL 130" (pH value: 3.7 to 4.5), "AEROSIL 150" (pH value: 3.7 to 4.5), "AEROSIL 200" (pH value: 3.7 to 4.5), "AEROSIL 255" (pH value: 3.7 to 4.5), "AEROSIL 300" (pH value: 3.7 to 4.5) and "AEROSIL 380" (pH value: 3.7 to 4.5) produced by Nippon Aerosil Co., Ltd.

[Base Material]

As the base material, one having a cylindrical shape, columnar shape or endless belt shape corresponding to the shape of the electrophotographic member can be used. The material of the base material is not particularly limited as long as the material is excellent in heat resistance and mechanical strength. Examples include metals such as aluminum, iron, copper and nickel, alloys such as stainless steel and brass, ceramics such as alumina and silicon carbide, and resins such as polyether ether ketone, polyethylene terephthalate, polybutylene naphthalate, polyester, polyimide, polyamide, polyamideimide, polyacetal and polyphenylene sulfide.

When such a resin is here used as the material of the base material, a conductive powder such as a metal powder, a conductive oxide powder or conductive carbon may be added to impart conductivity.

When the electrophotographic member has an endless belt shape, a resin excellent in flexibility is particularly suitably used as the material of the base material. As the material of a base material having an endless belt shape, polyether ether ketone including carbon black as a conductive powder and polyimide including carbon black as a conductive powder are particularly suitably used from the viewpoint of mechanical strength and conductivity. The thickness of the base material having an endless belt shape is, for example, 10 μm or more and 500 μm or less, particularly, 30 μm or more and 150 μm or less.

[Surface Layer]

The surface layer is a layer for preventing a toner and an external additive from adhering to the surface of the electrophotographic member. The resin for use in the surface layer is not particularly limited as long as the resin has low adhesion property, and examples include a fluororesin, a fluorine-containing urethane resin, fluororubber and siloxane-modified polyimide. In particular, a fluorine-containing urethane resin can be adopted from the viewpoint of not impairing the elastic function of the elastic layer.

The thickness of the surface layer is preferably 0.5 to 20 μm, more preferably 1 to 10 μm. When the thickness of the surface layer is 0.5 μm or more, toner disappearance due to wearing of the surface layer along with use is easily suppressed. In addition, when the thickness of the surface layer is 20 μm or less, the elastic function of the elastic layer is not inhibited.

The surface layer may, if necessary, include the above electroconductive agent. The content of the electroconductive agent in the surface layer can be 30 parts by mass or less relative to the surface layer from the viewpoint of adhesion property and mechanical strength.

A primer layer may also be, if necessary, provided between the elastic layer and the surface layer. The thickness of the primer layer is preferably 0.1 μm or more and 15 μm or less, more preferably 0.5 μm or more and 10 μm or less from the viewpoint of not impairing the elastic function.

<Electrophotographic Member>

The electrophotographic member according to the present embodiment can be used in a charging member, a development member, a transfer member, an intermediate transfer member, a toner-feeding member, a cleaning member and the like in an electrophotographic image forming apparatus. Among such members, the electrophotographic member can be particularly used in an intermediate transfer member.

The electrophotographic member according to the present embodiment can be produced by a method including forming a layer of an addition curable type liquid silicone rubber mixture including the addition curable type liquid silicone rubber and the ionic liquid on the base material, and curing the addition curable type liquid silicone rubber in the layer.

Formation of the layer of the addition curable type liquid silicone rubber mixture can be performed by coating the base material with the mixture according to a known method. Curing of the addition curable type liquid silicone rubber can be performed by, for example, heating at 160 to 180° C.

The resistance value of the electrophotographic member according to the present embodiment is preferably $1.0\times10^{6}$ Ω·cm or more and $1.0\times10^{14}$ Ω·cm or less, more preferably $1.0\times10^{8}$ Ω·cm or more and $1.0\times10^{13}$ Ω·cm or less, in terms of the volume resistivity. In addition, the surface resistivity measured from the surface layer is preferably $1.0\times10^{6}$Ω/□ or more and $1.0\times10^{14}$Ω/□ or less, more preferably $1.0\times10^{9}$ Ω/□ or more and $1.0\times10^{13}$Ω/□ or less. The resistance value of the electrophotographic member can be controlled within the semi-conductive area as described above, thereby allowing primary transfer and secondary transfer of a toner image from the electrophotographic photosensitive member to be stably performed in the case where the electrophotographic member is used in an intermediate transfer member.

<Electrophotographic Image Forming Apparatus>

One example of an electrophotographic image forming apparatus where the electrophotographic member according to the present embodiment is used in an intermediate transfer belt is described with reference to FIGURE. The present disclosure is not intended to be limited to the following description. An electrophotographic image forming apparatus 100 illustrated in FIGURE is a color electrophotographic image forming apparatus (color laser printer). The electrophotographic image forming apparatus is provided with image forming units Py, Pm, Pc and Pk of respective colors of yellow (Y), magenta (M), cyan (C) and black (K), in sequence in the direction of movement of such units, along with a flat portion of an intermediate transfer belt 7 as an intermediate transfer body. Herein, 1Y, 1M, 1C and 1K each represent an electrophotographic photosensitive member, 2Y, 2M, 2C and 2K each represent a charging roller, 3Y, 3M, 3C and 3K each represent a laser exposure apparatus, 4Y, 4M, 4C and 4K each represent a development section, and 5Y, 5M, 5C and 5K each represent a primary transfer roller. The respective image forming units are the same in basic configuration, and the details of the image forming units are described with reference to only a yellow image forming unit Py.

The yellow image forming unit Py includes a drum-type electrophotographic photosensitive member (hereinafter, also referred to as "photosensitive drum" or "first image carrier") 1Y as an image carrier. The photosensitive drum 1Y is formed by sequentially laminating a charge generation layer, a charge transport layer and a surface protection layer on an aluminum cylinder as a substrate. The yellow image forming unit Py includes a charging roller 2Y as a charging unit. A charging bias is applied to the charging roller 2Y, thereby evenly charging the surface of the photosensitive drum 1Y.

The laser exposure apparatus 3Y is provided, as an image exposure unit, above the photosensitive drum 1Y. The laser exposure apparatus 3Y scan-exposes the surface of the photosensitive drum 1Y evenly charged, depending on image information, to form an electrostatic latent image of a yellow color component on the surface of the photosensitive drum 1Y.

The electrostatic latent image formed on the photosensitive drum 1Y is developed by a toner as a developer in a development section 4Y as a development unit. The development section 4Y includes a development roller 4Ya as a developer carrier and a regulating blade 4Yb serving as a member for regulating the amount of the developer, and accommodates a yellow toner as a developer. The development roller 4Ya to which the yellow toner is fed is lightly pressure-contact with the photosensitive drum 1Y in the development section, and is rotated in a forward direction against the photosensitive drum 1Y with the difference in speed. The yellow toner conveyed to the development section by the development roller 4Ya adheres to the electrostatic latent image formed on the photosensitive drum 1Y, by application of a development bias to the development roller 4Ya. Thus, a visible image (yellow toner image) is formed on the photosensitive drum 1Y.

The intermediate transfer belt 7 is laid across a driving roller 71, a tension roller 72 and a driven roller 73, and is moved (rotatably driven) in the direction of an arrow in the drawing with being in contact with the photosensitive drum 1Y.

The yellow toner image formed on the photosensitive drum (first image carrier) reaching a primary transfer section Ty is primarily transferred to the surface of the intermediate transfer belt 7 by a primary transfer body (primary transfer roller 5Y) disposed facing the photosensitive drum 1Y with the intermediate transfer belt 7 being interposed therebetween.

An example is here described where the primary transfer roller is used as a transfer unit that primarily transfers the toner image formed on the photosensitive drum to the surface of the intermediate transfer belt. For example, however, when a conductive base material such as a metal is used as the base material of the intermediate transfer belt, a configuration may be adopted where a transfer voltage is applied to a space between the base material and the photosensitive drum. That is, the intermediate transfer belt by itself can also be used in a part of the transfer unit.

Similarly, the above image formation operation is made with respect to each of the units Pm, Pc and Pk of magenta (M), cyan (C) and black (K) according to the movement of the intermediate transfer belt 7, and respective toner images of four colors of yellow, magenta, cyan and black are stacked on the intermediate transfer belt 7. Such toner layers of the four colors are conveyed according to the movement of the intermediate transfer belt 7, and are collectively transferred onto a transfer material S (hereinafter, also referred to as "secondary image carrier") conveyed at a predetermined timing by a secondary transfer roller 8 as a secondary transfer unit in a secondary transfer section T'.

While a transfer voltage of several kV, for example, specifically, 1000 to 6000 V, which varies depending on the environment of usage and the type of paper, is usually applied in secondary transfer in order to ensure a sufficient transfer rate, discharge may be here caused in the vicinity of a transfer nip. Such discharge herein causes deterioration in surface characteristics of the intermediate transfer body.

The transfer material S is fed from a cassette 12 in which the transfer material S is received, to a conveyance path by a pick-up roller 13. The transfer material S fed to the conveyance path is conveyed to the secondary transfer section T' in synchronization with the four-color toner image transferred to the intermediate transfer belt 7 by a conveyance roller pair 14 and a resist roller pair 15.

The toner image transferred to the transfer material S is fixed by a fixing section 9 and formed into, for example, a full color image. The fixing section 9 includes a fixing roller 91 provided with a heating unit, and a pressure roller 92, and fixes a toner image not fixed, on the transfer material S, by heating and pressurizing. Thereafter, the transfer material S is ejected outside the apparatus by a conveyance roller pair 16, an ejection roller pair 17 and the like.

A cleaning blade 11 as a cleaning unit of the intermediate transfer belt 7 is provided downstream of the secondary transfer section T' in the driving direction of the intermediate transfer belt 7, and removes the transfer residual toner which is not transferred to the transfer material S in the secondary transfer section T' and which remains on the intermediate transfer belt 7.

As described above, an electrical transfer process of the toner image, from the photosensitive member to the intermediate transfer belt and from the intermediate transfer belt to the transfer material, is repeatedly performed. In addition, recording on a large number of transfer materials is repeated, resulting in further repeating of such an electrical transfer process.

The above electrophotographic member of the present disclosure can be then used in the intermediate transfer belt in the electrophotographic image forming apparatus, thereby suppressing the change over time in transfer (secondary transfer) efficiency of the toner image from the intermediate transfer belt to the recording medium such as paper. As a result, a high-quality electrophotographic image can be formed over a long period.

According to one embodiment of the present disclosure, an electrophotographic member high in volume resistivity uniformity even in application of a high voltage such as 1,000 V can be obtained. In addition, according to another embodiment of the present disclosure, an electrophotographic image forming apparatus that can stably form a high-quality electrophotographic image over a long period can be obtained.

EXAMPLES

In each of Examples and Comparative Examples, materials of a mixed dispersion liquid may be diluted with or dispersed in a solvent, and the amount of each material (part(s) by mass) means the amount of a non-volatile content, unless particularly noted, and such an amount means the amount where the amount of the solvent (volatile content) is excluded.

<Synthesis of Ionic Liquid>

Production Example 1: Synthesis of Siloxane-Modified Ionic Liquid 1

Siloxane-modified ionic liquid 1 was synthesized by coupling of a glycidyl-modified quaternary ammonium salt and a dimethylsiloxane modified by carboxy at one end.

Specifically, 3.97 g of a glycidyl trimethylammonium salt (trade name: GTA-IL, produced by Yokkaichi Chemical Company, Limited, anion: $TFSI^-$), 18.0 g of a polydimethylsiloxane modified by carboxy at one end (trade name: MBR-B12, molecular weight=1,500, produced by Gelest, Inc.) and 0.1 g of triethylamine (0.1 equivalents relative to the ammonium salt) as a catalyst were used, anhydrous acetonitrile was added thereto so that the total amount of the solution was 30 mL, and a reaction was made at 80° C. for 10 hours. After completion of the reaction, the solvent was distilled off by an evaporator, and purification was performed using column chromatography (trade name: silica gel 60N, 100 to 210 μm, produced by Kanto Kagaku).

The developing solvent of the column was not particularly limited as long as the developing solvent could dissolve a product and had an appropriate R/F value on a TLC (thin layer chromatography) plate, and a mixed solvent where ethyl acetate and n-hexane were mixed at any ratio was here used. Thereafter, the solvent was removed by an evaporator to provide siloxane-modified ionic liquid 1. The reaction formula is represented below.

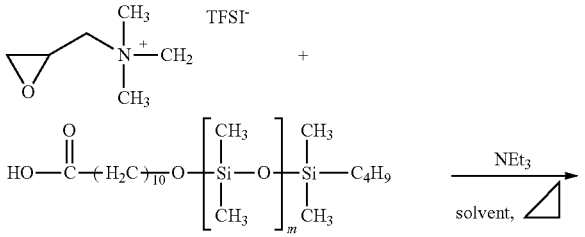

-continued

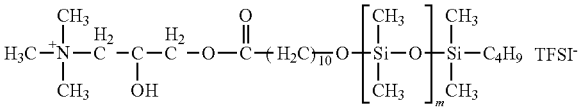

Each of siloxane-modified ionic liquids 2 to 4 was synthesized by coupling an allyl-modified imidazolium salt and a siloxane with hydrogen at one end according to a hydrosilylation reaction.

Production Example 2: Synthesis of Siloxane-Modified Ionic Liquid 2

After 2.10 g of 1-allyl-3-methylimidazolium tetrafluoroborate (produced by Kanto Kagaku), 10.45 g of a polydimethylsiloxane with hydrogen at one end (trade name: MCR-H07, molecular weight=about 700-1000, produced by Gelest, Inc.) and 50 mL of toluene were loaded in a flask and purged with nitrogen, the flask was sealed.

An isopropyl alcohol solution (0.1 mL) of 0.01% by mol tetrachloroplatinic(II) acid was dropped in the mixed liquid and heated to 80° C., and a reaction was made for 10 hours. After completion of the reaction, the solvent was distilled off by an evaporator, and purification was performed by the same operation as in Production Example 1, thereby providing siloxane-modified ionic liquid 2. The reaction formula is represented below.

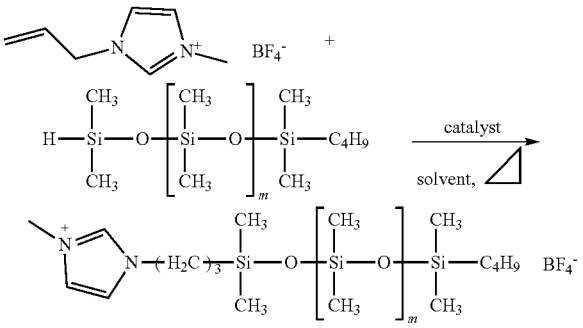

Production Example 3: Synthesis of Siloxane-Modified Ionic Liquid 3

Siloxane-modified ionic liquid 3 was obtained by the same method as in Production Example 2 except that a polysiloxane with hydrogen at one end (trade name: MCR-H21, molecular weight=about 4,500 to 5,000, produced by Gelest, Inc.) was used.

Production Example 4: Synthesis of Siloxane-Modified Ionic Liquid 4

Siloxane-modified ionic liquid 4 was obtained by the same method as in Production Example 2 except that 1-allyl-3-methylimidazolium bis(trifluoromethane)sulfonylimide (produced by Kanto Kagaku) where the anion was $TFSI^-$ was used.

Each of siloxane-modified ionic liquids 5 to 7 is one where imidazolium is modified at the 3-position by polysiloxane. First, for example, a molecule where halide (for example, chloro, bromo or iodo) is bound to an end of polydimethylsiloxane, and imidazole are subjected to a nucleophilic substitution reaction. Thereafter, an anion-exchange reaction can be made for substitution with any anion such as $TFSI^-$, thereby synthesizing an ionic liquid. Hereinafter, a specific synthesis method is described.

Production Example 5: Synthesis of Siloxane-Modified Ionic Liquid 5

First, with respect to a polydimethylsiloxane with hydroxy at one end being a commercially available product, such a hydroxy group at the end is halidated. A known procedure can be used for such halidation, and for example, an Appel reaction using triphenylphosphine and iodine can be utilized.

An eggplant flask was loaded with 20.0 g of a polydimethylsiloxane with hydroxy at one end (trade name: MCR-C12, molecular weight=1,000, produced by Gelest, Inc.) and 6.3 g of triphenylphosphine and was subjected to purging argon, and methylene chloride (100 mL) was added as a solvent. While the eggplant flask was cooled by ice, 5.1 g of iodine was added and a reaction was made for 30 minutes. Thereafter, a saturated aqueous sodium thiosulfate solution was dropped to stop the reaction, and the resulting reaction liquid was extracted by methylene chloride. Magnesium sulfate was added to the organic layer of the extract liquid to remove the water content, a precipitate was taken out by filtration and the solvent was removed by an evaporator. Next, purification was made using column chromatography (trade name: silica gel 60N, 100-210 μm, produced by Kanto Kagaku) and the solvent was removed by an evaporator, thereby providing a siloxane modified by halide at one end, where an alcohol at an end was halidated. The reaction formula is represented below.

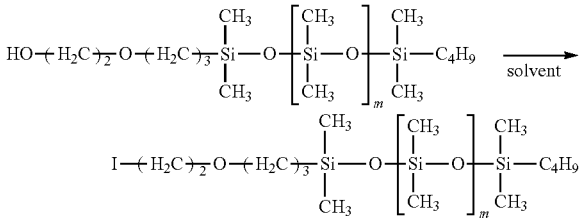

Next, the resulting siloxane modified by halide at one end and imidazole were reacted, in which 0.3 g of N-methylimidazole (produced by Tokyo Chemical Industry Co., Ltd.), 5.0 g of the resulting siloxane modified by halide at one end and 20 mL of acetonitrile as a solvent were added, and a reaction was made at room temperature for 3 hours. The solvent was removed by an evaporator, thereby synthesizing an intermediate made of imidazolium having siloxane, and a halide anion. The reaction formula is represented below.

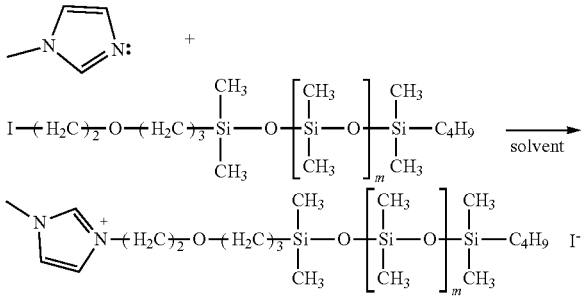

Subsequently, 20 mL of methanol was added to 2.5 g of the resulting intermediate, and one where 0.6 g of lithium bis(trifluoromethanesulfonyl)imide (produced by Kanto Kagaku) was dissolved in 10 mL of methanol was dropped. After a reaction was made at room temperature for 3 hours, the solvent was removed by an evaporator, and a product was purified by column chromatography and thereafter dried using a vacuum pump, thereby providing siloxane-modified ionic liquid 5. The reaction formula is represented below.

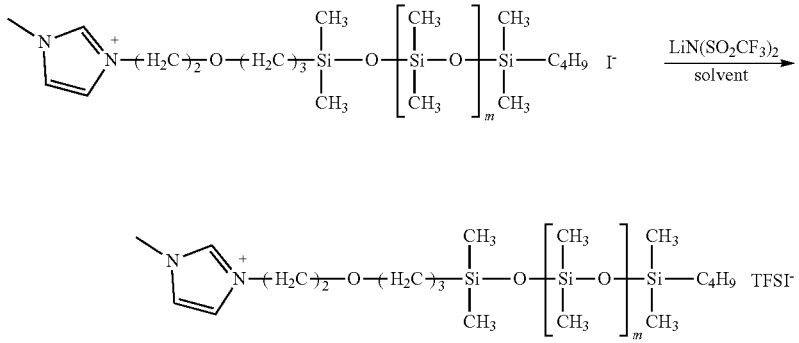

Production Examples 6 and 7: Synthesis of Siloxane-Modified Ionic Liquids 6 and 7

Siloxane-modified ionic liquids 6 and 7 were obtained by the same method as in Production Example 5 except that MCR-C18 (trade name, molecular weight=5,000, produced by Gelest, Inc.) and MCR-C22 (trade name, molecular weight=10,000, produced by Gelest, Inc.), respectively, were used as the polydimethylsiloxanes modified by hydroxy at one end.

Production Example 8: Synthesis of Siloxane-Modified Ionic Liquid 8

Siloxane-modified ionic liquid 8 was obtained by the same method as in Production Example 2 except that trivinylphenylphosphonium bromide (CAS No.: 5044-52-0) was used as the ionic liquid.

The structure of each of siloxane-modified ionic liquids 1 to 8 obtained is represented in Table 1.

TABLE 1

| Production Example | No. | Siloxane-modified ionic liquid Structure | m |
|---|---|---|---|
| 1 | 1 | 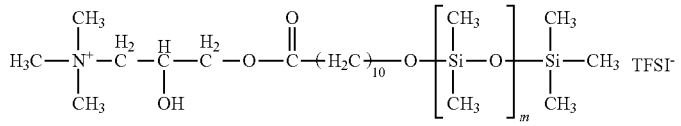 | 16 |
| 2 | 2 | 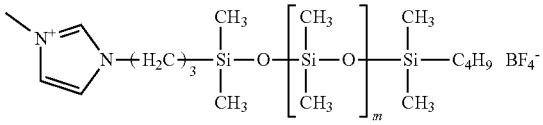 | about 8-10 |
| 3 | 3 | 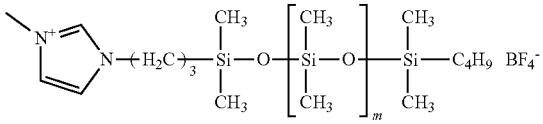 | about 60-64 |
| 4 | 4 | 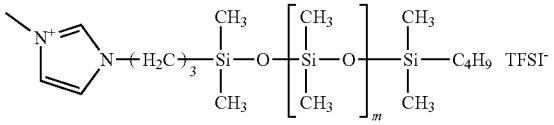 | about 8-10 |
| 5 | 5 | 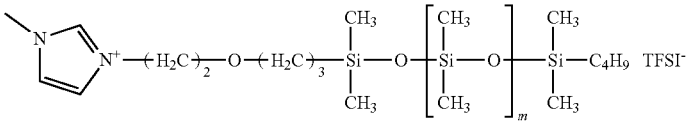 | 10 |
| 6 | 6 | 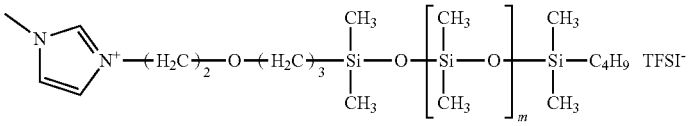 | 62 |
| 7 | 7 | 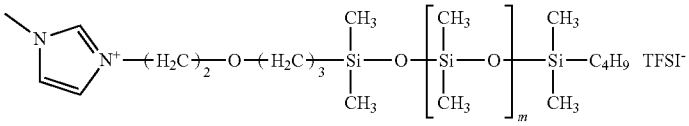 | 132 |
| 8 | 8 | 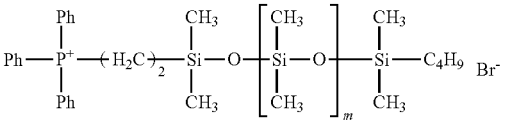 | about 8-10 |

<Production of Intermediate Transfer Belt>

Example 1

(Preparation of Base Material)

Each of the following materials was loaded in a biaxial kneader (trade name: PCM30, manufactured by Ikegai Corp.) by use of a weight feeder and kneaded to provide a pellet thereof. The cylinder setting temperature of the biaxial kneader was as follows: the temperature of a material-loading section was 320° C. and the temperature of each of the downstream of the cylinder and a die was 360° C. The number of screw rotations of the biaxial kneader was 300 rpm and the amount of each of the materials fed was 8 kg/h.

Polyether ether ketone (trade name: VICTREXPEEK450G, produced by Victrex PLC): 80 parts by mass Acetylene black (trade name: Denka Black granule, produced by Denka Company Limited): 20 parts by mass Next, the resulting pellet was subjected to cylindrical extrusion, thereby providing a belt. Such cylindrical extrusion was performed using a uniaxial extruder (trade name: GT40, produced by Plastics Technology Co., Ltd.) and a cylindrical die having a circular opening having a diameter of 300 mm and a gap of 1 mm. Specifically, a weight feeder was used to feed the pellet at an amount of feeding of 4 kg/h to the uniaxial extruder. The cylinder setting temperature of the uniaxial extruder was as follows: the temperature of a material-loading section was 320° C. and the temperature of each of the downstream of the cylinder and a cylindrical die was 380° C. A molten resin discharged from the uniaxial extruder passed through a gear pump and was extruded through the cylindrical die, and drawn by a cylindrical drawing machine at a speed so that the thickness was 60 The molten resin, when drawn, was brought into contact with a cooling mandrel provided between the cylindrical die and the cylindrical drawing machine and thus cooled/solidified. The resin solidified was cut by a cylindrical cutter installed at the lower portion of the cylindrical drawing machine so that the width was 300 mm, thereby providing a crystalline thermoplastic resin belt as a base material.

(Preparation of Elastic Layer)

Siloxane-modified ionic liquid 1 was used as a conductive agent. 0.2 parts by mass of siloxane-modified ionic liquid 1, and 1.0 parts by mass of a coloring agent (trade name: LIMS-Color 02; produced by Shin-Etsu Chemical Co., Ltd.) were added based on 100 parts by mass of addition curable type liquid silicone rubber (trade name: TSE 3450 A/B, produced by Momentive Performance Materials Inc.), and stirred/defoamed using a planetary stirring defoaming apparatus (trade name: HM-500, manufactured by Keyence Corporation), providing a mixed liquid of the liquid silicone rubber. Subsequently, the base material was attached to a cylindrical core, and a ring nozzle for rubber discharge was further attached coaxially with the core. A liquid-sending pump was used to feed the mixed liquid of the liquid silicone rubber to the ring nozzle, and the mixed liquid of the liquid silicone rubber was discharged through a slit, thereby coating the base material with the mixed liquid of the liquid silicone rubber. The relative movement speed and the amount of discharge from the liquid-sending pump were here adjusted so that the thickness of the silicone rubber layer after curing was 280 The resultant in the state of being attached to the core was placed in a heating furnace, and heated at 130° C. for 15 minutes and further heated at 180° C. for 60 minutes, thereby performing rubber crosslinking. After cooling, the belt was taken out from the core, thereby providing a belt where the elastic layer was stacked.

(Preparation of Surface Layer)

A fluorine-containing polyurethane resin liquid (trade name: Emralon T-861, produced by Henkel Japan Ltd.) where polytetrafluoroethylene was dispersed in a polyurethane dispersion was prepared. The elastic layer surface of the belt was subjected to a hydrophilic treatment by excimer UV irradiation and thereafter fitted to the core, and the belt was coated with the urethane resin liquid by use of a spray gun (trade name: W-101, manufactured by Anest Iwata Corporation) with rotation at 200 rpm. After the coating, the belt was placed in a heating furnace at 130° C. and left to stand for 30 minutes. The belt was taken out from the heating furnace, and cooled, thereby providing intermediate transfer belt 1 including a surface layer having a thickness of 3 μm on the elastic layer.

Examples 2 to 8

Each of intermediate transfer belts 2 to 8 was produced in the same manner as in Example 1 except that each of siloxane-modified ionic liquids 2 to 8 was used as the conductive agent in preparation of the elastic layer in Example 1.

Example 9

Intermediate transfer belt 9 was produced in the same manner as in Example 1 except that 10 parts by mass of carbon black (trade name: "Denka Black granule"; produced by Denka Company Limited) was added as the additive (electroconductive agent) in preparation of the elastic layer in Example 1.

Comparative Example 1

Intermediate transfer belt 9 was produced in the same manner as in Example 1 except that an alkyl-modified ionic liquid (methyltrioctylammonium/$TFSI^-$, produced by Wako Pure Chemical Industries, Ltd.) having no dimethylsiloxane chain was used in preparation of the elastic layer in Example 1.

Comparative Example 2

Intermediate transfer belt 10 was produced in the same manner as in Example 1 except that an alkoxysilyl-modified ionic liquid (trade name: IL-S3, produced by Koei Chemical Co., Ltd.) was used in preparation of the elastic layer in Example 1.

<Evaluation>

Each of the resulting intermediate transfer belts was subjected to measurement of the volume resistivity and evaluation of the volume resistivity uniformity (resistance variation), as well as image evaluation, as described below. The results are shown in Table 2.

[Measurement of Volume Resistivity and Evaluation of Uniformity]

The volume resistivity value was defined as the average value obtained by subjecting a transfer belt having a cylindrical shape having a perimeter of 1147 mm to measurement at 58 points and at an interval of 20 mm. In addition, the volume resistivity uniformity was defined as the "maximum value/minimum value" with respect to the maximum value and the minimum value of the volume resistivity measured at 58 points. The volume resistivity was measured using a high resistivity meter (trade name: Hairesta MCP-HT450, manufactured by Mitsubishi Chemical Analytech Co., Ltd.) according to a double electrode method. The value in application of 1000 V/10 sec. by use of a UR probe was used. Measurement of the volume resistivity was performed in an environment of 25° C. and 55% RH.

[Measurement of Surface Resistivity]

The surface resistivity was measured using a high resistivity meter (trade name: Hairesta MCP-HT450, manufactured by Mitsubishi Chemical Analytech Co., Ltd.) in the same manner as in the volume resistivity. The value in application of 1000 V/10 sec. by use of a UR probe was used. Measurement of the surface resistivity was performed in an environment of 25° C. and 55% RH.

[Image Evaluation]

The intermediate transfer body (intermediate transfer belt) according to each of Examples and Comparative Examples was installed instead of an intermediate transfer belt installed to a full color electrophotographic image forming apparatus (trade name: imagePRESS C800, manufactured by Canon Inc.). A blue solid image was then output on A4-size plain paper (trade name: CS814, manufactured by Canon Inc.). For image formation, cyan and magenta developers mounted on respective print cartridges of the electrophotographic image forming apparatus were used. In addition, outputting of the image was performed under a normal-temperature and normal humidity environment (temperature: 25° C., relative humidity: 55%). The full color electrophotographic image forming apparatus included a transfer roller formed by disposing a primary transfer unit facing an electrophotographic photosensitive member with an intermediate transfer belt being interposed therebetween. The primary transfer voltage was 1000 to 3000 V.

After the image was output, the cyan and magenta developers were used and Rezak 66250 g A3-size paper as embossed paper was used to output a solid image of a secondary color, and the resulting solid image was evaluated according to the following procedure. The solid image was read using a scanner (trade name: CanoScan 9000F, manufactured by Canon Inc.) at an interpolated resolution of 600 dpi with image correction processing being OFF, and trimming was performed within the area of 2,550×2,550 pixels (approximately 10.8×10.8 cm). The resulting image was visually observed at a display magnification of 200%, and evaluation was made with respect to whether or not the variation in image due to the variation in resistance was observed, and, in the case of the variation observed, the degree of such variation was evaluated according to the following criteria.

Rank A: no image variation was observed at all.

Rank B: slight variation was partially observed.

Rank C: variation was observed in an area corresponding to about two tenth of the image observed.

Rank D: variation was observed in more than half of the image observed.

TABLE 2

| | | Intermediate transfer belt No. | Ionic conductive agent: Cation | Ionic conductive agent: Amount added [part(s) by mass] | Additive: Material | Additive: Amount added [part(s) by mass] | Surface resistivity [Ω/□] | Volume resistivity [Ω · cm] | Volume resistivity uniformity, max/min | Image evaluation rank |
|---|---|---|---|---|---|---|---|---|---|---|
| Example | 1 | 1 | Siloxane-modified ionic liquid No. 1 | 0.2 | — | — | $5.91 \times 10^{10}$ | $8.59 \times 10^{10}$ | 1.10 | A |
| | 2 | 2 | Siloxane-modified ionic liquid No. 2 | 0.2 | — | — | $6.44 \times 10^{10}$ | $8.68 \times 10^{10}$ | 1.98 | B |
| | 3 | 3 | Siloxane-modified ionic liquid No. 3 | 0.2 | — | — | $8.16 \times 10^{10}$ | $1.23 \times 10^{11}$ | 1.07 | A |
| | 4 | 4 | Siloxane-modified ionic liquid No. 4 | 0.2 | — | — | $8.11 \times 10^{10}$ | $9.76 \times 10^{10}$ | 1.85 | B |
| | 5 | 5 | Siloxane-modified ionic liquid No. 5 | 0.2 | — | — | $1.06 \times 10^{11}$ | $4.17 \times 10^{11}$ | 1.05 | A |
| | 6 | 6 | Siloxane-modified ionic liquid No. 6 | 0.2 | — | — | $1.23 \times 10^{11}$ | $6.38 \times 10^{11}$ | 1.13 | A |
| | 7 | 7 | Siloxane-modified ionic liquid No. 7 | 0.2 | — | — | $3.57 \times 10^{11}$ | $9.51 \times 10^{11}$ | 1.67 | B |
| | 8 | 8 | Siloxane-modified ionic liquid No. 8 | 0.2 | — | — | $1.55 \times 10^{11}$ | $2.23 \times 10^{11}$ | 1.08 | A |
| | 9 | 9 | Siloxane-modified ionic liquid No. 1 | 0.2 | Carbon black | 10 | $1.02 \times 10^{10}$ | $1.22 \times 10^{10}$ | 1.17 | A |
| Comparative Example | 1 | 10 | Alkyl-modified ionic liquid | 0.2 | — | — | $4.79 \times 10^{11}$ | $7.43 \times 10^{11}$ | 11.97 | D |
| | 2 | 11 | Alkoxysilyl-modified ionic liquid | 0.2 | — | — | $4.91 \times 10^{11}$ | $7.76 \times 10^{11}$ | 3.84 | C |

It can be seen from the above results that an intermediate transfer belt including a siloxane-modified ionic liquid is high in volume resistivity uniformity as compared with an intermediate transfer belt including an alkyl-modified or alkoxy-modified ionic liquid.

The effect exerted by a cation structure of a siloxane-modified ionic liquid is the same as the effect exerted by quaternary ammonium and imidazolium and it is thus indicated that various cation structures can be utilized in the present disclosure.

In addition, the following tendency is confirmed: a siloxane structure modified is enhanced in volume resistivity uniformity as the dimethylsiloxane chain is longer. In Example 7, the volume resistivity uniformity was relatively low as compared with Example 1. The reason is considered because the molecular weight of the siloxane chain is high and therefore the viscosity of the siloxane-modified ionic liquid is increased to cause compatibility of the ionic liquid with the addition curable type liquid silicone rubber to be relatively low.

In addition, even when any of $BF_4^-$ and $TFSI^-$ was used in the anion group, the influence on the volume resistivity uniformity was small. It is thus indicated that various structures can be utilized in the anion group in the present embodiment.

Carbon black was used as the electroconductive agent in combination with polysiloxane-modified ionic liquid 1 in Example 8. The effect of the present disclosure, however, is not particularly impaired. Therefore, it has been found that combination use with various additives can also be made.

Example 10

Intermediate transfer belt 12 was produced in the same manner as in Example 9 except that carbon black was changed to 2.2 parts by mass of hydrophilic silica (trade name: "AEROSIL 200"; produced by Nippon Aerosil Co., Ltd) in Example 9.

Example 11

Intermediate transfer belt 13 was produced in the same manner as in Example 10 except that the amount of siloxane-modified ionic liquid 1 added was changed to 0.5 parts by mass in Example 13.

Each of intermediate transfer belts 12 to 13 was evaluated as in Example 1.

Furthermore, the volume resistivity was measured in the same manner as described above except that the voltage applied to the intermediate transfer belt by use of the UR probe in measurement of the volume resistivity was changed to 100 V/10 sec.

Reference Example 1

Intermediate transfer belt 13 was produced in the same manner as in Example 9. Measurement of the volume resistivity of intermediate transfer belt 14 was performed in the same manner as described above except that the voltage applied to the intermediate transfer belt by use of the UR probe was changed to 100 V/10 sec. The results are shown in Table 3 below.

TABLE 3

| | | Ionic conductive agent | | Additive | | | Voltage applied (1000 V/10 sec.) | | Voltage applied (100 V/10 sec.) | | |
|---|---|---|---|---|---|---|---|---|---|---|---|
| | Intermediate transfer belt No. | Cation | Amount added [part(s) by mass] | Material | Amount added [part(s) by mass] | Surface resistivity [Ω/□] | Volume resistivity [Ω · cm] | Volume resistivity uniformity max/min | Volume resistivity [Ω · cm] | Volume resistivity uniformity max/min | Image evaluation rank |
| Example 10 | 12 | Siloxane-modified ionic liquid No. 1 | 0.2 | Hydrophilic silica | 2.2 | $4.38 \times 10^{10}$ | $3.52 \times 10^{10}$ | 1.08 | $8.51 \times 10^{10}$ | 0.58 | A |
| 11 | 13 | Siloxane-modified ionic liquid No. 1 | 0.5 | Hydrophilic silica | 2.2 | $8.01 \times 10^{9}$ | $6.46 \times 10^{9}$ | 1.11 | $1.52 \times 10^{10}$ | 0.76 | A |
| Reference Example 1 | 14 | Siloxane-modified ionic liquid No. 1 | 0.2 | Carbon black | 10 | $1.02 \times 10^{10}$ | $1.22 \times 10^{10}$ | 1.17 | $1.58 \times 10^{11}$ | 0.87 | A |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-095720, filed May 12, 2017, and Japanese Patent Application No. 2018-071724, filed Apr. 3, 2018, which are hereby incorporated by reference herein in their entirety.

What is claimed is:

1. An electrophotographic member comprising a base material and an elastic layer on the base material, wherein the elastic layer comprises a silicone rubber and an ionic liquid, wherein the ionic liquid comprises a cation modified by a dimethylsiloxane chain, and an anion, wherein the cation has any of structures represented by structural formulae (1) to (4):

structural formula (1)

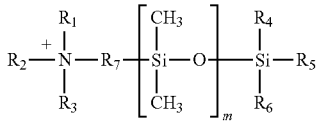

structural formula (2)

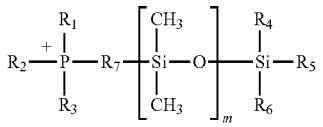

-continued structural formula (3)

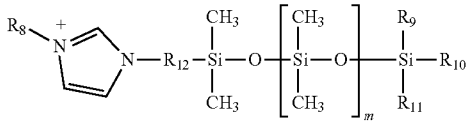

-continued structural formula (4)

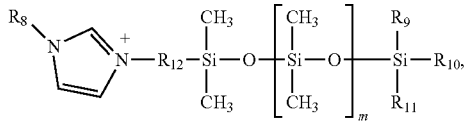

wherein in the structural formula (1) and the structural formula (2), each of $R_1$ to $R_3$ independently represents an alkyl group having 1 to 10 carbon atoms, an alkoxy group having 1 to 10 carbon atoms, a hydroxyl group, a benzyl group, a phenyl group or a carboxyl group; each of $R_4$ to $R_6$ independently represents an alkyl group having 1 to 10 carbon atoms; $R_7$ represents an alkylene group having 1 to 20 carbon atoms and optionally having a substituent, wherein the alkylene group optionally comprises a group selected from the group consisting of phenylene, —O—, —C(═O)—, —C(═O)—O— or C(═O)—NR—, wherein R represents an alkyl group having 1 to 6 carbon atoms; and m represents an integer of 1 to 150, wherein in the structural formula (3) and the structural formula (4), each $R_8$ independently represents an alkyl group having 1 to 10 carbon atoms, an alkoxy group having 1 to 10 carbon atoms, a benzyl group or a carboxyl group; each of $R_9$ to $R_{11}$ independently represents an alkyl group having 1 to 10 carbon atoms; $R_{12}$ represents an alkylene group having 1 to 20 carbon atoms and optionally having a substituent, wherein the alkylene group optionally comprises a group selected from the group consisting of phenylene, —O—, —C═O—, —C═O—O— or —C═O—NR—, wherein R represents an alkyl group having 1 to 6 carbon atoms; and m represents an integer of 1 to 150, and wherein the elastic layer comprises 0.01 to 10 parts by mass of the ionic liquid based on 100 parts by mass of the silicone rubber.

2. The electrophotographic member according to claim 1, wherein the elastic layer is a cured product of an addition curable silicone rubber mixture comprising addition curable liquid silicone rubber and an ionic liquid.

3. The electrophotographic member according to claim 1, wherein the anion is at least one selected from the group consisting of $Br^-$, $AlCl_4^-$, $Al_2Cl_7^-$, $NO_3^-$, $BF_4^-$, $PF_6^-$, $CH_3COO^-$, $CF_3COO^-$, $CF_3SO_3^-$, $(CF_3SO_2)_3C^-$, $AsF_6^-$, $SbF_6^-$, $F(HF)n^-$, $CF_3CF_2CF_2CF_2SO_3^-$, $(CF_3CF_2SO_2)_2N^-$, $CF_3CF_2CF_2COO^-$ and $(CF_3SO_2)_2N^-$.

4. The electrophotographic member according to claim 1, wherein the elastic layer comprises 0.05 to 5 parts by mass of the ionic liquid based on 100 parts by mass of the silicone rubber.

5. The electrophotographic member according to claim 1, wherein the elastic layer further comprises an electroconductive agent.

6. The electrophotographic member according to claim 1, wherein the elastic layer comprises a first surface facing the base material and a second surface opposite to the first surface, and wherein the electrophotographic member further comprises a surface layer on the second surface.

7. The electrophotographic member according to claim 6, wherein a thickness of the surface layer is 0.5 μm to 20 μm.

8. The electrophotographic member according to claim 6, wherein a surface resistivity measured on an outer surface of the surface layer is $1.0\times10^6$ Ω/□ to $1.0\times10^{14}$ Ω/□.

9. The electrophotographic member according to claim 1, wherein a volume resistivity of the electrophotographic member is $1.0\times10^6$ Ω·cm to $1.0\times10^{14}$ Ω·cm.

10. The electrophotographic member according to claim 9, wherein the volume resistivity of the electrophotographic member is $1.0\times10^8$ Ω·cm to $1.0\times10^{13}$ Ω·cm.

11. The electrophotographic member according to claim 1, wherein the electrophotographic member is an electrophotographic belt having an endless belt shape.

12. The electrophotographic member according to claim 11, wherein a thickness of the base material is 10 μm to 500 μm.

13. The electrophotographic member according to claim 1, wherein the elastic layer further comprises hydrophilic silica.

14. A method for producing the electrophotographic member according to claim 1, the method comprising:

forming a layer of a mixture of addition curable liquid silicone rubber and the ionic liquid on a base material, and curing the addition curable liquid silicone rubber in the layer of the mixture.

15. An electrophotographic image forming apparatus comprising an electrophotographic photosensitive member and an intermediate transfer belt, wherein the intermediate transfer belt is the electrophotographic member according to claim 1.

16. The electrophotographic image forming apparatus according to claim 15, wherein the elastic layer comprises a first surface facing the base material and a second surface opposite to the first surface, and wherein the electrophotographic member further comprises a surface layer on the second surface.

17. The electrophotographic image forming apparatus according to claim 15, wherein the electrophotographic image forming apparatus further comprises a unit that applies a transfer voltage for transfer of a toner image formed on the electrophotographic photosensitive member to a surface of the intermediate transfer belt.

18. The electrophotographic image forming apparatus according to claim 17, wherein the transfer voltage is 1000 to 6000 V.

19. The electrophotographic image forming apparatus according to claim 17, wherein the unit that applies a transfer voltage comprises a transfer roller disposed facing the electrophotographic photosensitive member with the intermediate transfer belt being interposed therebetween.

* * * * *